US006069845A

United States Patent [19]

Ambs

[11] Patent Number: 6,069,845

[45] Date of Patent: May 30, 2000

[54] COMPOSITE MARINE SEISMIC SOURCE

[75] Inventor: Loran D. Ambs, Fulshear, Tex.

[73] Assignee: Western Altas International Inc., Houston, Tex.

[21] Appl. No.: 09/220,148

[22] Filed: Dec. 23, 1998

[51] Int. Cl.[7] ..... H04R 17/00

[52] U.S. Cl. ..... 367/165; 367/159; 181/113; 310/337; 310/369

[58] Field of Search ..... 367/141, 157, 367/159, 165, 160; 310/337, 369; 181/110, 113, 119, 120

[56] References Cited

U.S. PATENT DOCUMENTS

| | | | |
|---|---|---|---|
| 2,543,500 | 2/1951 | Kettering et al. | 310/369 |
| 4,220,887 | 9/1980 | Kompanek | 310/337 |
| 5,020,035 | 5/1991 | Kompanek | 367/159 |
| 5,103,130 | 4/1992 | Rolt et al. | 310/337 |
| 5,229,978 | 7/1993 | Flanagan et al. | 367/159 |
| 5,267,223 | 11/1993 | Flanagan et al. | 367/159 |
| 5,357,486 | 10/1994 | Pearce | 367/159 |
| 5,875,154 | 2/1999 | Dechico | 367/163 |

*Primary Examiner*—Ian J. Lobo
*Attorney, Agent, or Firm*—Alan J. Atkinson

[57] ABSTRACT

A marine seismic source for generating acoustic source energy from electrical power. A slotted housing has an exterior surface engaged with an electrically activated transducer such as a piezoelectric transducer. One or more piezoelectric components can be adhered or otherwise attached to the exterior surface of the housing. A case can cover all or part of the piezoelectric components, and the case can be waterproof to prevent contact between the transducer and the water. The case can be integrated with the slotted housing to form a composite structure, or a cavity, for containing a transducer such as piezoelectric components.

14 Claims, 2 Drawing Sheets

COMPOSITE MARINE SEISMIC SOURCE

BACKGROUND OF THE INVENTION

The invention described herein relates to the field of seismic sources in marine geophysical operations. More particularly, the invention relates to a unique marine seismic source using a slotted cylinder piezoelectric transducer to generate low frequency seismic source energy.

Marine seismic vessels tow vibrators, air guns, explosives and other acoustic projector techniques to generate seismic source energy in marine geophysical operations. The seismic source energy is represented by a pressure pulse in the water. The pressure pulse generated travels downwardly through the water and underlying geologic structures and is reflected from interfaces between the geologic structures. The reflected signal impulses return to the water column and are detected with sensors towed behind the seismic vessel or positioned on the water bottom.

Source signals for marine geophysical operations are typically generated with acoustic sources such as compressed air guns. U.S. Pat. No. 4,180,139 to Walker (1979), U.S. Pat. No. 4,285,415 to Paitson (1981), and U.S. Pat. No. 5,228,010 to Harrison (1993) disclosed different mechanisms for discharging compressed air into water to generate acoustic source energy.

U.S. Pat. No. 3,896,889 to Bouyoucos (1975) disclosed a mass oscillation system for generating acoustic source energy in water. Other devices generate an acoustic signal by transmitting high velocity water jets in the underwater water environment. U.S. Pat. No. 4,131,178 to Buoyoucos (1978) and U.S. Pat. No. 4,153,135 to Bouyoucos (1975) disclosed a moveable piston for generating high velocity water jets.

Acoustic energy sources have been developed for sonar and other vessel detection systems. U.S. Pat. No. 4,651,044 to Kompanek (1987) disclosed a sonar transducer formed having a plurality of sectionalized piezoelectric elements attached to the interior wall of a slotted cylinder. Each element was constructed with a ceramic material having piezoelectric characteristics and was bonded with adhesive to the interior cylinder wall. An array of slotted cylinder segments in different rotational orientations were encapsulated in a boot and were filled with oil to prevent water intrusion. The orientation and placement of the piezoelectric elements on the interior cylinder walls controlled the orientation of the generated acoustic energy. In another embodiment, the piezoelectric elements were oriented linearly across the slotted cylinder internal diameter and were attached to the cylinder interior walls at opposite sides of the cylinder interior.

Other variations and improvements to acoustic energy sources have been developed. U.S. Pat. No. 5,122,992 to Kompanek (1992) disclosed a transducer member having a closure member extending in a U-shaped configuration, and U.S. Pat. No. 5,267,223 to Flanagan et al. (1993) disclosed a compliant cover bonded to a transducer shell.

Conventional seismic sources require distribution of compressed air which adds weight and frictional drag to towed arrays. Existing slotted cylinder acoustic energy sources for underwater vessel detection operate at frequencies and power ranges unsuitable for geophysical operation. Accordingly, there is a need for an improved seismic source generator for use in marine seismic operations. The generator should be adaptable to different source energy requirements and should be easy to manufacture and deploy.

SUMMARY OF THE INVENTION

The invention discloses an improved marine seismic source for exploring geologic formations underlying water.

The apparatus comprises a housing having an exterior surface and being moveable to generate a pressure pulse in the water, and an electrically activatable transducer engaged with the housing exterior surface. The transducer is activatable to move said housing to generate the pressure pulse for exploring the geologic formations.

In other embodiments of the invention, a case can be engaged with the transducer or with the housing. The transducer can comprise one or more piezoelectric elements, and a slot can be positioned within the housing for permitting movement of the housing when the transducer is activated.

In another embodiment of the invention, a housing has an exterior surface, an interior surface, and a slot for permitting movement of said housing to generate a pressure pulse in the water. A cavity within said housing has a contact surface at least partially positioned within said housing, and an electrically activatable transducer is positioned within said housing cavity and is engaged with said contact surface for moving said housing to generate the pressure pulse in the water.

DESCRIPTION OF THE PREFERRED EMBODIMENTS

Figure 1:
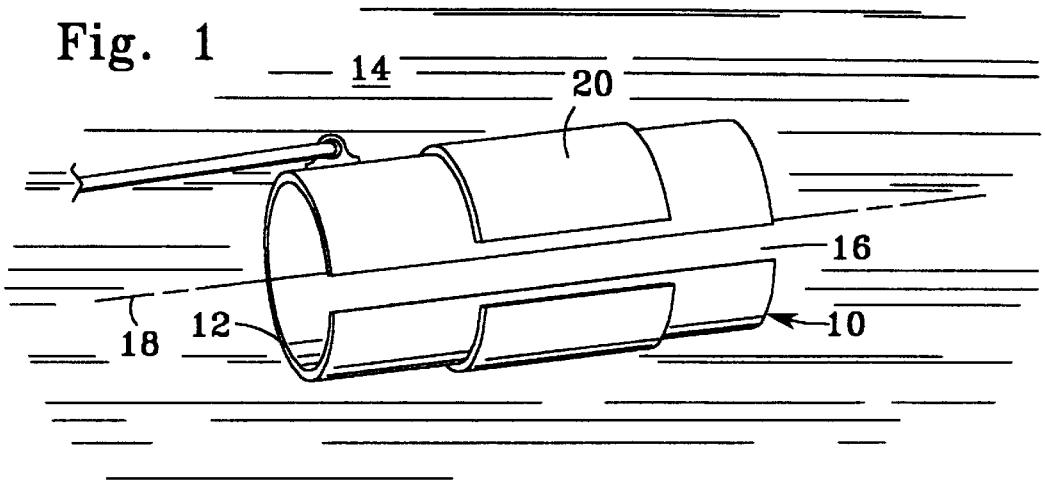
FIG. 1 illustrates an acoustic source apparatus.
Figure 2A:
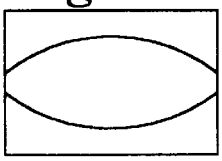
FIGS. 2 (A–F) illustrate different forms of slots for permitting movement of a housing.
Figure 2B:
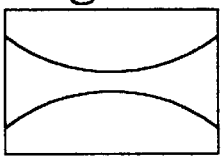
Figure 2C:
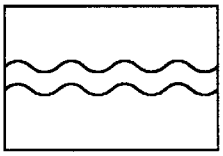
Figure 2D:
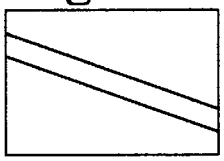
Figure 2E:
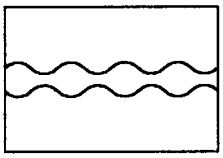
Figure 2F:
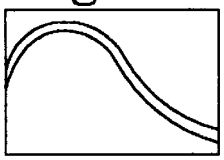

The invention provides an improved seismic source for use in marine geophysical operations. Referring to FIG. 1, acoustic source apparatus 10 is illustrated as comprising housing 12 in water 14. Stress relief recess, slot, or slot portion such as slot 16 can be integrated along all or a portion of housing 12. Housing 12 can be cylindrical, circular, elliptical, irregular, or another shape, and can incorporate one or more slots 16 for permitting expansion of housing 12 or other movement sufficient to produce a pressure pulse. Although housing 12 is illustrated as a single component, housing 12 can be formed with two or more components capable of moving relative to the other. Apparatus 10 can be neutrally buoyant, powered or unpowered, controlled remotely or autonomously, and can be integrated with control equipment known in the art to provide manueverability horizontally, vertically, or laterally in water 14.

As shown in FIG. 1, housing 12 has slot 16 along a line parallel to the longitudinal axis 18 of housing 12. Slot 16 permits radial expansion of housing 12 in response to a displacement force. The terms "slot" or "slotted" as used herein refer to any configuration which permits relative movement between two different points on housing. Movement in a radial direction by any parts of housing will generate acoustic source energy in water suitable to use in marine seismic operations. To generate larger amounts of source energy, and assuming the amount of surface area displacement is equal, movable housings having larger surface areas will generate more source energy than housings having lesser surface areas. The "slot" can be circular, elongated, curvilinear, oblique, sawtoothed, irregular, or any other shape suitable for providing housing movement. FIGS. 2 (A–F) illustrate different forms of suitable slots and are representative of slot configurations without showing each possible slot form or arrangement.

Figure 3:
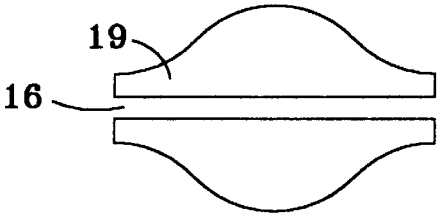
FIG. 3 illustrates an irregularly shaped housing for controlling pressure pulse characteristics in the water.

Slot 16 provides the principal function of permitting relative movement between different parts of housing. Slot 16 and housing 12 can also be configured to affect the mechanical characteristics of the transducer, and the acoustic energy pulse characteristics resulting from the transducer. As shown above, housing is illustrated as a slotted cylinder. In another embodiment as shown in FIG. 3, housing 19 can be shaped irregularly so that movement of housing 19 in response to activation of transducer elements deforms part of housing 19 to a degree greater than the deformation of other parts. In the example shown, the middle part of housing 19 is deformed. Since natural resonance of housing 19 is partly dependent upon the housing 19 diameter and shape, the transducer efficiency can be tailored by selective shaping of housing 19. A cylindrical housing having a constant diameter along an axis would have a higher "Q" factor than would a housing of variable diameter.

Figure 4:
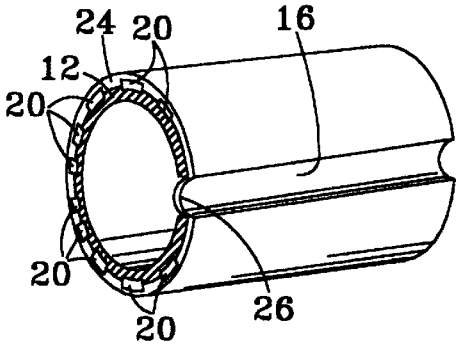
FIG. 4 illustrates a case over the transducer and housing.

Housing 12 in FIG. 4 is moved to produce the desired vibration by activating piezoelectric element or elements 20 attached to the outside or exterior surface 22 of housing 12, or within the interior of a composite structure as described below. "Piezoelectric" refers to the generation of electric polarity in dielectric crystals subjected to mechanical stress, and the generation of stress in such crystals when subjected to an applied voltage. Piezoelectric element 20 can be formed from a single element or from a series or combination of piezoelectric elements 20 as shown in FIG. 1. As defined herein, references to a single piezoelectric 20 means one or more elements.

When an electric potential is applied to piezoelectric elements 30, such elements expand and force housing 12 to contract radially inwardly. Such radial contraction is facilitated by slot 16 and changes the volume of housing 12 to produce a pressure field or pulse in water 14. The pressure pulse provides acoustic seismic source energy sufficient for penetrating subsurface geologic formations and for reflected signal detection by hydrophones or other sensors.

Figure 5:
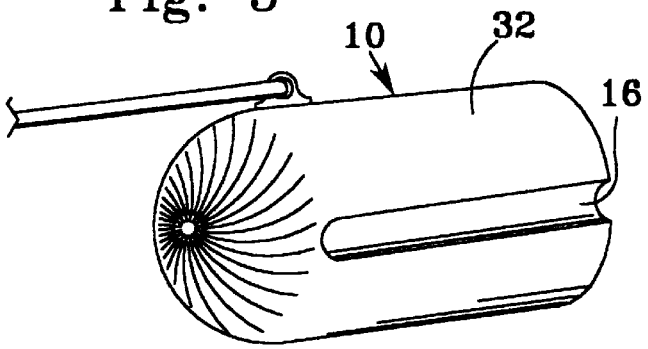
FIG. 5 illustrates a waterproof case.

As shown in FIG. 4, a case or cover such as flexible seal 24 can bridge slot 16 for the purposes of providing impact resistance, elastic restraint for housing 12, or for preventing water intrusion into contact with housing 12 or piezoelectric elements 20. Seal 24 can comprise any suitable sealing material including rubber, synthetic cloth, plastic, composite fabric, spring steel or other metal, or another material. Seal 24 can combine with piezoelectric elements 20 and with housing 12 to form an integrated, composite structure. Although seal 24 does not require fluid tight capabilities, seal 24 preferably encloses the interior of housing 12 to prevent fluid intrusion within the interior of housing 12 or to prevent water 14 from contacting piezoelectric components 20. Seal 32 is shown in FIG. 5 as wrapping completely around the exterior surface of source apparatus 10, however, seal 24 could also be limited proximate to slot 16 as shown in FIG. 4 to limit the surface area covered by seal 24. Seal 24 can include fold 26 to permit elastic, radial expansion and contraction of housing 12 without mechanically stressing seal 24.

Although piezoelectric element 20 is shown as having a relatively uniform thickness, piezoelectric element 20 can be constructed in many different shapes and combinations to accomplish a design objective. In other embodiments of the invention as shown in FIG. 4, a combination of piezoelectric elements 20 can be positioned exterior of housing 12 to magnify the movement of housing 12 following actuation of piezoelectric elements 20. By placing piezoelectric elements 20 on outside housing surface 22, manufacture and repair of source apparatus 10 is facilitated. Pie-shaped elements are more readily accessible and allow the removal of any single element without disturbing proximal elements. The form and construction of such combination can be altered to accomplish different design objectives.

Figure 6:
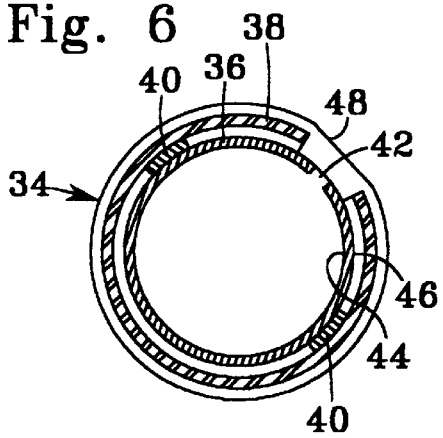
FIG. 6 illustrates a housing engaged with a frame for supporting a transducer.

FIG. 6 illustrates another embodiment of the invention wherein housing 34 forms a composite structure having slotted cylinder 36 and outer frame 38 which cooperate to constrain transducer 40. Slotted cylinder 36 has slot 42, inner surface 44 and outer surface 46. Transducer 40 is engaged with outer surface 46 and is sandwiched between slotted cylinder 36 and frame 38. The combination of such components provides a composite structure for generating acoustic seismic energy in water. Housing 34 and frame 38 can comprise two or more components or can be integrated into a single structure. Different layers of different materials, whether flexible or relatively rigid, can be used in the fabrication of housing 34. Transducer 40 can cover all or a small portion of outer surface 46. In one embodiment of the invention, case 48 can retain or encase frame 38, transducer 40, and slotted cylinder 36. Case 48 can be waterproof or can permit movement of water 14 into contact with transducer 40 or slotted cylinder 36.

Figure 7:
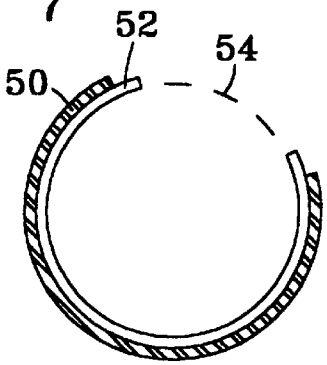
FIG. 7 illustrates a transducer oriented to compress a housing for the generation of a pressure pulse.

FIG. 7 illustrates another embodiment of the invention wherein transducer 50 is arranged to expand or contract the outer surface of housing 52 when transducer 50 is activated. Slot 54 permits such movement. If drive signal output to transducer 50 does not return housing 52 to the initial position, elasticity of housing 52 supplies the force to return housing 52 to the initial, original position. Such movement of housing 52 displaces water and generates a pressure pulse in water which comprises acoustic source energy.

Figure 8:
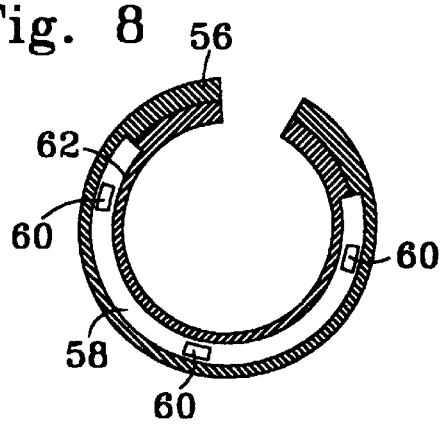
FIG. 8 illustrates a transducer positioned within a cavity in a slotted housing.

FIG. 8 illustrates another embodiment of the invention wherein slotted housing 56 has cavity 58 for containing transducer 60 within a composite style signal generator. Cavity 58 has inner contact surface 62 completely or partially incorporated within housing 56. Transducer 60 engages contact surface 62 at one or more locations for transferring force between transducer 60 and housing 56. Although contact surface 62 is illustrated as planar in configuration, points of engagement between housing 56 and transducer 60 are also suitable for transferring force therebetween. Cavity 58 can be open or can be filled with a liquid, semisolid, or solid material. By placing transducer 60 within cavity 58, transducer 60 is protected from impacts from exterior objects and is capable of exerting forces in different directions relative to housing 56. The unique combination of transducer 60, cavity 58, and housing 56 permits forces to be transferred in radial and tangential directions between transducer 60 and housing 56. This capability provides flexibility in the design of housing 56 and transducer 60 and permits the design of different acoustic sources providing different energy generating capabilities and acoustic characteristics.

By using electric power as the energy source for moving a slotted housing, power transmission can be supplied from a seismic tow vessel through streamers or cables towed by the vessel. The invention is deployed by selectively operating piezoelectric element or elements 20 with electricity provided by an integrated or remote power source. Movement of piezoelectric element 30 moves housing 12 to generate the acoustic source energy in a low frequency range at a high power level. The reliance upon a simple elastic system in the form of a movable housing substantially eliminates frictional wear, mechanical wear, and abrasion between the operable components. The invention provides an easily towable, reduced friction, dependable seismic energy source. Housing 12 can be towed through the water or can function as a separate device moving independently of the vessel. The position of housing 12 can be identified and recorded by global positioning systems ("GPS"), having an antenna located above the water surface, or other positioning equipment (e.g. acoustic, radio, laser, and others) and a controller located in the water, on board the vessel, or at land based processing facilities.

The present invention uniquely provides an efficient acoustic energy method and source which can be highly controller to provide seismic source energy in marine geophysical operations. The invention permits near point source generation of acoustic source energy, instead of using multiple air gun arrays many tens of meters long and across.

The invention provides numerous advantages over prior art marine seismic source techniques, and provides superior signal control from a single element instead of the multi-string, multi-gun arrays conventionally used. By providing for solid state actuation of piezoelectric element 20 and elastic amplification of housing 12, the mechanical and electrical simplicity of the invention provides superior performance when compared with conventional systems having complex mechanical components subject to wear, tuning requirements, and complex electrical interfaces. The cost of the invention is significantly less than conventional seismic sources, and the total cost of operation is reduced because of lower drag in water 14 and the increased efficiency over conventional air gun systems. The compact size of the invention reduces deck space required on vessels, and control over the source energy reduces negative impact on marine life. The selectivity over the frequency content and power of the source energy offers significant processing capabilities not available with conventional systems, and the invention offers the potential for simultaneous, orthogonal pseudo-random sweeps to facilitate increased coverage rate or spatial sampling.

The invention provides unique advantages not provided by conventional seismic source systems. By providing source energy from a single element instead of conventional multi-string, multi-gun arrays, the signal power is superior. By providing a solid state system, the apparatus significantly increases system reliability by eliminating the mechanical and electrical components in conventional source guns.

Although the invention has been described in terms of certain preferred embodiments it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A marine seismic source for exploring geologic formations underlying water, comprising:

a housing deployable in the water, wherein said housing has an exterior surface and is moveable to generate a pressure pulse in the water;

an electrically activatable transducer comprising a plurality of piezoelectric elements attached to said housing exterior surface, wherein said transducer is activatable to move said housing to generate the pressure pulse for exploring the geologic formations; and a slot in said housing for permitting movement of said housing caused by activation of said transducer.

2. A seismic source as recited in claim 1, wherein said slot is irregular in shape.

3. A seismic source as recited in claim 1, further comprising a case engaged with said transducer for containing movement of said transducer.

4. A seismic source as recited in claim 3, wherein said case is waterproof to prevent contact between the water and said transducer.

5. A marine seismic source for exploring geologic formations underlying water, comprising:

a housing deployable in the water and having an exterior surface;

a slot in said housing for permitting movement of said housing to generate source energy;

an electrically activatable piezoelectric transducer comprising a plurality of piezoelectric elements attached to said housing exterior surface, wherein said transducer is activatable to move said housing to generate the source energy; and a case positioned exterior of said slot.

6. A seismic source as recited in claim 5, wherein said case comprises a flexible membrane for permitting movement of said transducer and said slotted housing following activation of said transducer.

7. A seismic source as recited in claim 5, wherein said case is moveable to accommodate movement of said piezoelectric transducer and said housing.

8. A seismic source as recited in claim 5, wherein said case resists impact damage to said piezoelectric transducer.

9. A seismic source as recited in claim 5, wherein said piezoelectric transducer comprises a plurality of piezoelectric elements positioned between said housing exterior surface and said case.

10. A seismic source as recited in claim 5, further comprising at least two housings and associated transducers and cases, wherein each housing is positioned at a selected orientation relative to the other housing for selectively controlling the acoustic pulse transmitted into the water.

11. A marine seismic source for producing acoustic source energy in water in marine seismic operations, comprising:

a housing having an exterior surface, an interior surface, and a slot for permitting movement of said housing to generate a pressure pulse in the water;

a cavity within said housing, wherein said cavity has a contact surface at least partially positioned within said housing; and an electrically activatable transducer comprising a plurality of piezoelectric elements attached to said housing cavity and engaged with said contact surface, wherein said transducer is activatable to move said housing to generate the pressure pulse in the water.

12. A seismic source as recited in claim 11, wherein said housing comprises a composite structure formed with at least two materials.

13. A seismic source as recited in claim 12, wherein said materials are bonded in layers.

14. A seismic source as recited in claim 11, further comprising at least two housings engaged with each other for independent generation of pressure pulses in the water.

* * * * *